US008783376B2

(12) United States Patent
Congdon et al.

(10) Patent No.: US 8,783,376 B2
(45) **Date of Patent: *Jul. 22, 2014**

(54) CUTTER FOR DOZING BLADE, SERVICE PACKAGE, AND METHOD

(75) Inventors: Thomas M. Congdon, Dunlap, IL (US); Nick W. Biggs, Princeville, IL (US); Kevin L. Martin, Washburn, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/570,814

(22) Filed: Aug. 9, 2012

(65) Prior Publication Data

US 2014/0041886 A1 Feb. 13, 2014

(51) Int. Cl.
*E02F 3/80* (2006.01)

(52) U.S. Cl.
USPC ..... 172/701.3; 37/266

(58) Field of Classification Search
USPC ..... 172/701.1, 701.2, 701.3, 719, 772, 172/772.5, 811, 815; D15/32; 37/266, 446
See application file for complete search history.

(56) References Cited

U.S. PATENT DOCUMENTS

| | | | | |
|---|---|---|---|---|
| 2,841,897 | A | 7/1958 | Duke | |
| 2,914,868 | A * | 12/1959 | Launder | 172/701.2 |
| 2,959,307 | A | 11/1960 | Schwartz | |
| 2,965,989 | A * | 12/1960 | Hibbard | 172/701.2 |
| 3,011,274 | A * | 12/1961 | Richter | 37/449 |
| 3,016,637 | A * | 1/1962 | Abel | 172/701.3 |
| 3,029,534 | A * | 4/1962 | Rakisits | 172/701.2 |
| 3,238,648 | A | 3/1966 | Cobb et al. | |
| 3,258,864 | A * | 7/1966 | Beyers | 172/785 |
| 3,289,331 | A * | 12/1966 | Freeman | 172/701.2 |
| 3,429,381 | A * | 2/1969 | Launder et al. | 172/815 |
| 3,456,370 | A * | 7/1969 | Gilbertson | 172/701.2 |
| 3,528,509 | A | 9/1970 | Bleyker | |
| 3,559,749 | A | 2/1971 | Fryrear et al. | |
| 3,997,988 | A * | 12/1976 | Klett | 37/450 |
| 4,044,481 | A * | 8/1977 | Eftefield et al. | 172/701.2 |
| 4,069,604 | A * | 1/1978 | Stepe | 37/448 |
| 4,086,967 | A * | 5/1978 | Eftefield et al. | 172/777 |
| 4,390,071 | A | 6/1983 | Wright | |
| 4,991,662 | A * | 2/1991 | Caron et al. | 172/701.1 |
| 5,392,864 | A | 2/1995 | Lindenmuth | |
| D477,610 | S | 7/2003 | Matsumoto et al. | |

(Continued)

FOREIGN PATENT DOCUMENTS

| | | |
|---|---|---|
| WO | 93-22512 A1 | 11/1993 |
| WO | 2004-044337 A1 | 5/2004 |

OTHER PUBLICATIONS

Biggs et al., Dozing Blade Assembly, Cutter and Dozing Method, U.S. Appl. No. 13/333,013, filed Dec. 21, 2011, 29 pages.

(Continued)

*Primary Examiner* — Matthew D Troutman
(74) *Attorney, Agent, or Firm* — Liell & McNeil

(57) ABSTRACT

A cutter for a dozing blade includes a middle, first, and second section, each defining a plurality of bolting holes for receiving bolts to mount the cutter in a service configuration upon a dozing blade. The first and second sections each define a greater face angle between digging and mounting faces which is about 20° or less, and the middle section defines a lesser face angle between digging and mounting faces. The cutter may be provided in a service package for installation in place of a used cutter in a dozing blade.

14 Claims, 7 Drawing Sheets

(56) References Cited

U.S. PATENT DOCUMENTS

| | | | | |
|---|---|---|---|---|
| D478,098 | S * | 8/2003 | Matsumoto et al. | D15/11 |
| 6,938,701 | B2 | 9/2005 | Matsumoto et al. | |
| 7,013,983 | B2 | 3/2006 | Matsumoto et al. | |
| D534,929 | S | 1/2007 | Matsumoto et al. | |
| D538,307 | S | 3/2007 | Matsumoto et al. | |
| 7,191,846 | B2 | 3/2007 | Matsumoto et al. | |
| D554,159 | S * | 10/2007 | Boggs et al. | D15/32 |
| 7,401,658 | B2 | 7/2008 | Matsumoto et al. | |
| 7,654,336 | B2 | 2/2010 | Matsumoto et al. | |
| 7,690,441 | B2 | 4/2010 | Matsumoto et al. | |
| 7,810,581 | B2 | 10/2010 | Matsumoto et al. | |
| 8,272,451 | B2 * | 9/2012 | Ditzler | 172/818 |
| 2005/0098332 | A1 * | 5/2005 | Matsumoto et al. | 172/811 |
| 2008/0314607 | A1 * | 12/2008 | May | 172/701.3 |
| 2010/0031538 | A1 | 2/2010 | Hall | |
| 2011/0024142 | A1 * | 2/2011 | Ditzler | 172/701.1 |

OTHER PUBLICATIONS

Congdon et al, Track-Type Tractor, Dozing Blade Assembly, and Dozing Blade, U.S. Appl. No. 13/482,195, filed May 29, 2012, 35 pages.

* cited by examiner

CUTTER FOR DOZING BLADE, SERVICE PACKAGE, AND METHOD

TECHNICAL FIELD

The present disclosure relates generally to a cutter for a dozing blade, and relates more particularly to a multi-piece cutter configuration for optimized dozing efficiency.

BACKGROUND

Tractors equipped with dozing blades are used for a great many different purposes. Applications which will be familiar to most include pushing loose material such as landfill trash, construction debris, and soil about a worksite. Such dozing activities are indispensable to forestry, waste handling, building construction, and light to medium civil engineering. Small to mid-sized tractors are commonly used in these industries.

Dozing is also an integral part of larger scale activities such as mining and major civil engineering projects. In these contexts, rather than pushing loose material across a surface, tractors equipped with dozing blades are often used to dig material from a substrate. In the case of rocky terrain, commonly encountered in opencast mines, or where substrate materials otherwise have a high structural integrity, quite large and powerful machines equipped with rugged dozing blades are often required. These and analogous activities are generally referred to as "production dozing." In production dozing, a tractor equipped with a heavy-duty dozing blade is typically driven across, and through, a substrate such that a cutting edge of the dozing blade penetrates downward and forward through the material of the substrate, overcoming the structural integrity of the material, and causing it to fail. In large scale surface mining activities, a tractor, typically equipped with ground engaging tracks, may make successive passes across an area where surface material is to be removed, forming a slot in the substrate in each pass. Due to the harsh environment, frequent repair, replacement, and servicing of the equipment is often necessary. Moreover, to maximize productivity it is often desirable to employ machine operators who are highly skilled. Operators of lesser skill are often observed to manipulate a dozing blade or otherwise operate a tractor such that the tractor stalls while attempting to form a slot in a substrate. In other instances, rather than stalling the tractor, operators can sometimes cut a slot that is too shallow than what is theoretically possible, or even skim the dozing blade across a surface of the substrate without loosening any substantial amount of material over at least a portion of a given pass. Stalling the machine, or removing too little material, understandably impacts efficiency. For these and other reasons, there remains a premium in the pertinent industries on sophisticated equipment design and operation, as well as operator skill.

U.S. Pat. No. 3,238,648 to D. E. Cobb et al. is directed to a bulldozer with a stinger bit, for the apparent purpose of enabling a reasonably deep cut through hard material without overtaxing the tractor engine and tractive ability. These goals are apparently achieved by making the stinger bit adjustable or retractable, such that it can be used to ease initial penetration. This design would apparently enable a normal use of the full width of the blade, and an alternative use with the stinger bit extended. While Cobb et al. may have provided advantages over the state of the art at that time, there remains ample room for improvement. Moreover, the features necessary to enable the functionality of the stinger bit, such as hydraulic actuators and the like, can add non-trivial expense, complexity and maintenance requirements to the machine.

SUMMARY

In one aspect, a cutter for a dozing blade in an implement system of a tractor includes an elongate multi-piece body having a middle body section and a first and a second outer body section, each including a proximal edge and a distal cutting edge. The middle, first, and second body sections each further include a front digging face, a back mounting face, and define a plurality of bolting holes communicating between the digging and mounting faces. The bolting holes are configured to receive bolts for mounting the elongate multi-piece body in a service configuration upon a mounting surface of the dozing blade, in which the mounting faces are positioned in a first plane and the distal cutting edges are positioned in a second plane transverse to the first plane. The first and second body sections each define a greater face angle between their digging and mounting faces which is about 20° or less, and the middle body section defines a lesser face angle between its digging and mounting faces, such that in the service configuration the digging face of the middle body section is less steeply inclined to the first plane and more steeply inclined to the second plane than the digging faces of the first and second body sections.

In another aspect, a dozing blade service package includes a replacement cutter for installation in place of a used cutter in a dozing blade of an implement system in a tractor. The replacement cutter includes an elongate multi-piece body having a middle body section and a first and a second outer body section, each including a proximal edge, and a distal cutting edge. The middle, first, and second body sections each further include a front digging face extending between the proximal and distal edges, a back mounting face, and define a plurality of bolting holes communicating between the digging and mounting faces. The plurality of bolting holes are configured to receive bolts for mounting the elongate multi-piece body for service upon a mounting surface of the dozing blade oriented obliquely to a horizontal ground surface, such that the mounting faces are oriented parallel to the mounting surface and the distal cutting edges are oriented transverse to the mounting surface. The first and second body sections each further define a greater face angle between their digging and mounting faces which is about 20° or less, and the middle body section defines a lesser face angle between its digging and mounting faces, such that when mounted for service the digging face of the middle body section is less steeply inclined to the mounting surface and more steeply inclined to the horizontal ground surface than the digging faces of the first and second body sections. The service package further includes a packaging system securing the middle, first, and second body sections in a fixed configuration for shipping.

In still another aspect, a method of preparing a dozing blade in an implement system of a tractor for service includes positioning a first and a second outer section of a cutter at a first and a second outboard location, respectively, upon a mounting surface of the dozing blade. The method further includes positioning a middle section of the cutter at a middle location upon the mounting surface between the first and second outboard locations. The method further includes orienting the cutter in a service configuration upon the dozing blade via the positioning steps, such that a front digging face of the middle section is more steeply inclined to a horizontal ground surface than front digging faces of the first and second sections. The method still further includes attaching the cutter to the dozing blade in the service configuration.

DETAILED DESCRIPTION

Figure 1:
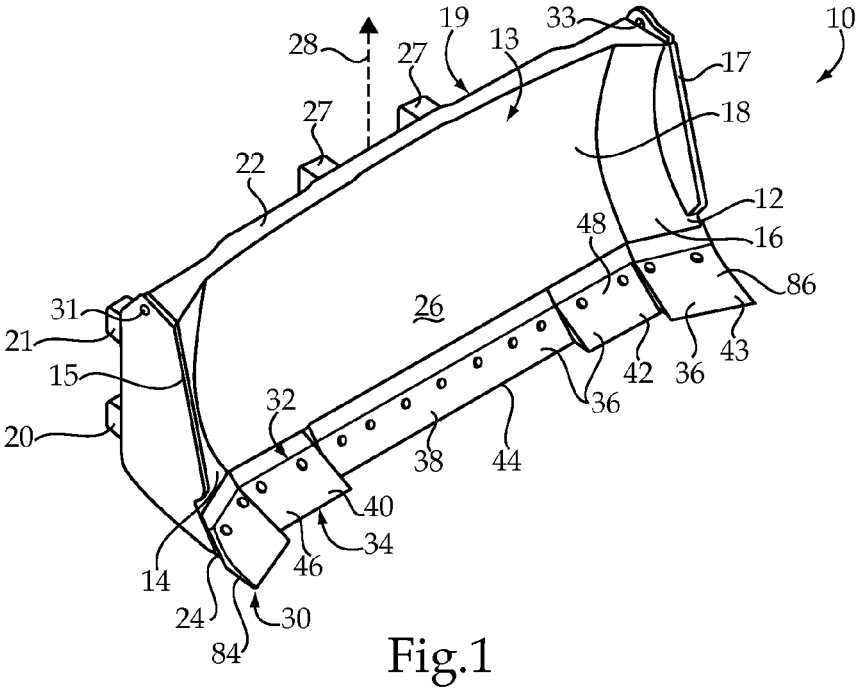
FIG. 1 is a diagrammatic view of a dozing blade assembly having a cutter, according to one embodiment.

Referring to FIG. 1, there is shown a dozing blade assembly 10 for an implement system in a tractor, according to one embodiment. Assembly 10 may include a dozing blade 12 having a front side 13, a back side 19, a first outboard wing 14 and a second outboard wing 16. A forwardly located moldboard 18 extends between first and second outboard wings 14 and 16. Blade 12 further includes a first side plate 15 and a second side plate 17 positioned outboard of and coupled to wings 14 and 16. A plurality of rearwardly located push-arm mounts 20, one of which is diagrammatically shown, are positioned at back side 19, for coupling assembly 10 with push-arms of a tractor. A plurality of tilt actuator connectors 21 are likewise positioned at back side 19, in a conventional manner. Blade 12 further includes an upper edge 22 and a lower edge 24. A material molding surface 26 is located in part on moldboard 18, and in part on each of wings 14 and 16 and extends from side plate 15 to side plate 17. Material molding surface 26 has a concave vertical profile extending between upper and lower edges 22 and 24, and a concave horizontal profile. Blade 12 may further include a first lifting eye 31 and a second lifting eye 33 located upon, within or proximate side plates 15 and 17, near back side 19, for coupling blade 12 with a tractor in a conventional manner. A plurality of lift actuator connectors 27 are positioned along upper edge 22. Although it is contemplated that assembly 10 may be configured for lifting and lowering, tilting, and possibly pivoting when coupled with the tractor, the present disclosure is not thereby limited. Blade 12 defines a generally vertical axis 28, located mid-way between connectors 27. As will be further apparent from the following description, assembly 10 is uniquely configured for balancing the relative ease with which assembly 10 penetrates material of a substrate with the relative ease with which assembly 10 may be pushed forward through the substrate, to optimize dozing efficiency.

To this end, assembly 10 may further include a cutter 30 mounted to blade 12 and having a trailing or proximal cutting edge 32 positioned adjacent material molding surface 26, and a leading or distal edge 34. Cutter 30 may further include a compound digging face 36 extending between proximal edge 32 and distal edge 34. Digging face 36 includes a center segment 38 oriented at a steep angle relative to a horizontal plane, for example the plane of the page in FIG. 1 which is approximately normal to axis 28. Digging face 36 may further include a first outer segment 40 and a second outer segment 42 adjoining center segment 38. Each of segments 40 and 42 may be oriented at a shallow angle relative to the horizontal plane. The differently oriented digging faces, or digging face segments, enable balancing downward penetrability with forward pushability of assembly 10 through material of a substrate. The terms "steep" and "shallow" are used herein in comparison with one another. The horizontal plane may be self-defined by assembly 10 based upon its service orientations. If assembly 10 were rested upon the ground on front side 13 or back side 19, the "horizontal" plane would extend generally vertically and transverse to the ground surface. Where rested approximately as shown in FIG. 1, the horizontal plane is substantially the same as a horizontal plane defined by the underlying substrate upon which assembly 10 is resting. Horizontal and vertical directions or orientations may also be understood in reference to the vertical and horizontal terms used in describing the concave profiles of surface 26.

Cutter 30 may include an elongate, multi-piece body 43 having a middle body section 44, a first outer body section 46 and a second outer body section 48. Middle body section 44 may have center segment 38 of digging face 36 located thereon, whereas first and second outer body sections 46 and 48 may have first and second outer segments 40 and 42, respectively, of digging face 36 located thereon. Each of segments 38, 40 and 42 might also be understood independently as a "digging face," but are referred to herein as segments for ease of description. Cutter 30 may still further include a first end plate 84 and a second end plate 86 aligned with first and second outboard wings 14 and 16, respectively. Middle body section 44 and outer body sections 46 and 48 may extend between first and second end plates 84 and 86 and are aligned with moldboard 18. End plates 84 and 86 may have the form of end "bits" in certain embodiments, comprising a casting or forging having a shape other than a simple plate. The present disclosure is not limited to any particular end plate or bit configuration, and different styles may suit different dozing applications.

Figure 2:
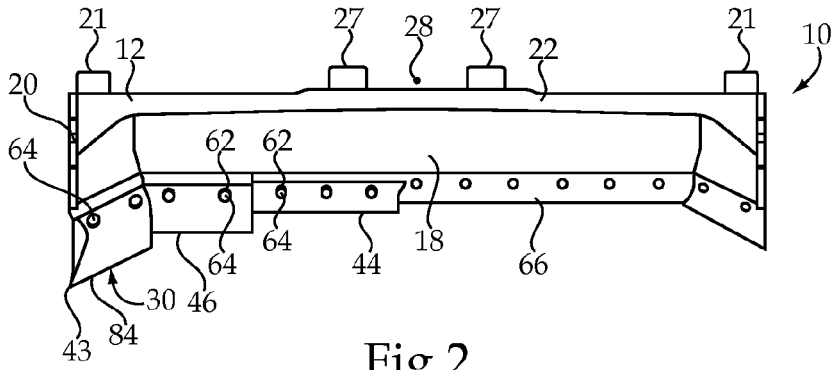
FIG. 2 is a top view of the dozing blade assembly of FIG. 1.

Referring now to FIG. 2, there is shown a top view of assembly 10, in partial cut-away where body section 42, end plate 86 and part of body section 44 are not shown, and illustrating a planar mounting surface 66 of blade 12. Another planar mounting surface (not numbered) is shown adjacent surface 66, for mounting end plate 86. The portions of blade 12 obscured by cutter 30 in FIG. 2 are configured similarly to those visible. In preparing dozing blade 12 for service, first and second sections 46 and 48 may be positioned at first and second outboard locations upon mounting surface 66, and middle section 44 may be positioned at a middle location on mounting surface 66 between the first and second outboard locations. Positioning sections 44, 46 and 48 thusly orients their respective digging face segments in a desired manner further discussed herein. Also shown in FIG. 2 are a plurality of bolts 64 extending through a plurality of bolting holes 62. In a practical implementation strategy, each of middle body section 44 and first and second outer body sections 46 and 48 may define a plurality of bolting holes 62 communicating between front digging face segments 38, 40 and 42 and back mounting faces not visible in FIG. 2 and described hereinafter. Bolting holes 62 are configured to receive bolts 64 for mounting body 43 upon mounting surface 66 in a service configuration, in particular being received in registering bolting holes in blade 12 to attach cutter 30 to blade 12 in the service configuration. End plates 84 and 86 may similarly define a plurality of bolting holes for analogous purposes. It may be noted from FIGS. 1 and 2 that proximal edge(s) 32 of sections 44, 46 and 48 together have a continuous linear profile in a first plane defined by mounting surface 66, whereas distal cutting edges 34 together have a discontinuous indented profile in a second plane transverse to the first plane, which in the illustrated case is a horizontal plane defined by a ground surface upon which assembly 10 is resting and the same as the plane of the page in FIGS. 1 and 2.

Figure 3:
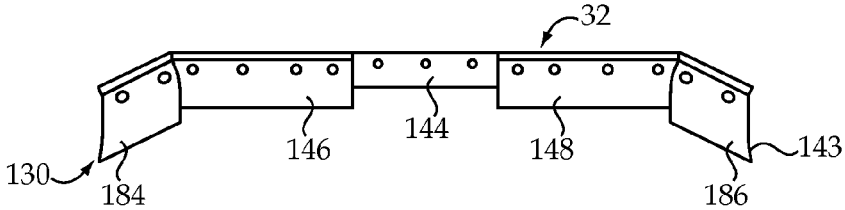
FIG. 3 is a top view of a cutter, according to another embodiment.

Referring now to FIG. 3, there is shown a cutter 130 according to another embodiment, and having a middle body section 144, outer body sections 146 and 148, and end plates 184 and 186. Each of the body sections may be part of an elongate multi-piece body 143, similar to elongate body 43, but differing with respect to the relative lengths of the respective body sections. It will be noted that a length of middle body section 144 relative to sections 146 and 148 is relatively less than the length of middle body section 44 relative to sections 46 and 48 in the foregoing embodiment. Thus, the middle section of a cutter according to the present disclosure may be either longer or shorter than the corresponding outer sections. It is contemplated that many embodiments according to the present disclosure may be configured as retrofit kits or service packages, where individual body sections are coupled with a mounting surface of a dozing blade in place of a conventionally designed cutter.

Figure 4:
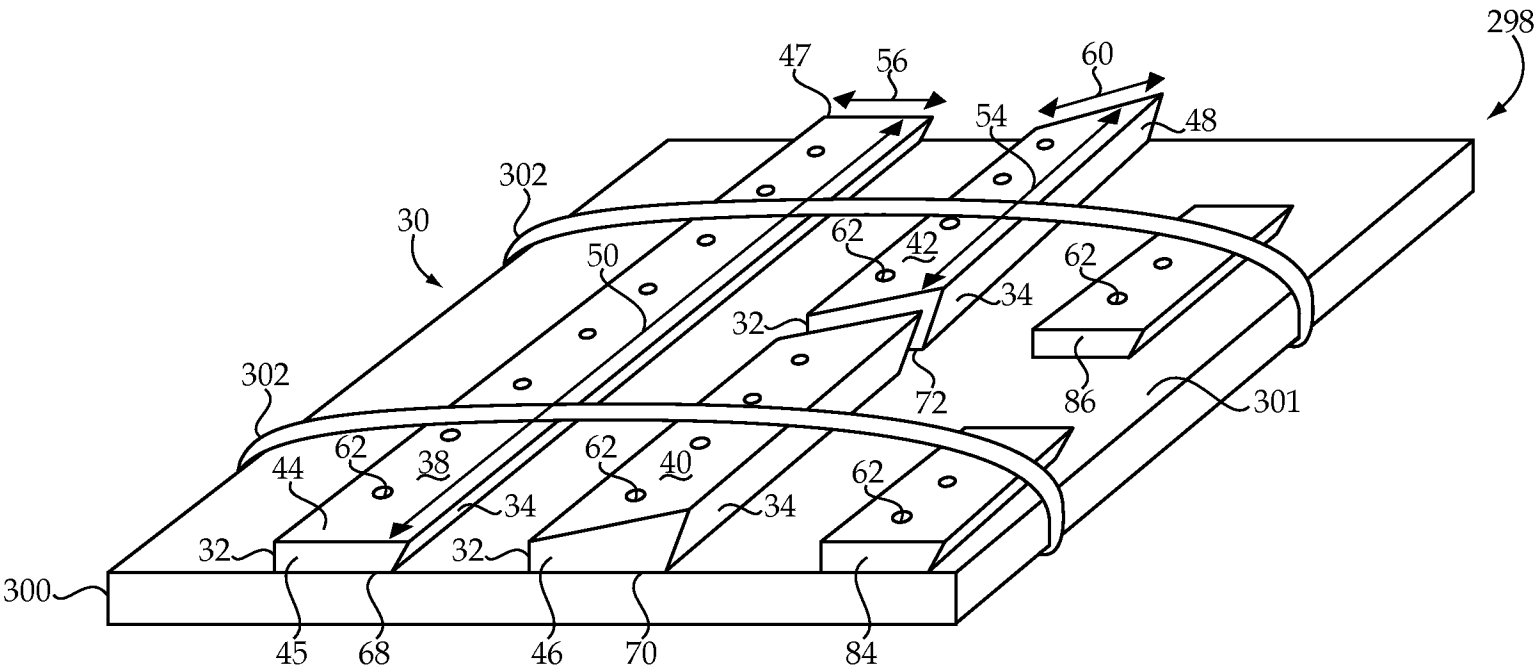
FIG. 4 is a diagrammatic view of a cutter prepared for shipping in a dozing blade service package, according to one embodiment.

Referring now also to FIG. 4, there is shown a dozing blade service package 298 including cutter 30 disassembled and packaged in a packaging system 299 having a package base 300 or pallet and securing straps or the like 302. Service package 298 is shown as it might appear where packaging system 299 secures body sections 44, 46, and 48 in a fixed configuration for shipping. Cutter 30 may serve as a replacement cutter for installation in place of a used cutter in a dozing blade of an implement system in a tractor, where the used cutter is of a similar configuration, or where the used cutter is conventionally configured such that cutter 30 provides an upgrade or a field modification for certain substrates. It is contemplated that a plurality of replacement cutter service packages might be kept on hand, each having a differently configured cutter which can be swapped in for an existing cutter depending upon field conditions. For instance, as production dozing removes over burden using a first cutter, different substrate materials might be encountered which are best handled by a second type of cutter. A sandy substrate might overlie a rocky substrate, for example. Differently configured cutter body sections might also be included in each service package, allowing parts to be mixed and matched as desired.

As noted above, lengths of certain of the components of cutter 30, and other embodiments contemplated herein, may be varied from the relative lengths and aspect ratios shown in the embodiments of FIGS. 1-3. In FIG. 4, reference numeral 50 indicates a length of middle body section 44 extending between a first outboard edge 45 and a second outboard edge 47, generally parallel edges 32 and 34. Outer body sections 46 and 48 have analogously defined lengths between outboard edges. Reference numeral 54 indicates a length of outer body section 48. Outer body sections 46 and 48 may, in at least most embodiments, be equal in length and width to one another. A width of middle body section 44 is indicated with reference numeral 56, whereas a width of outer body section 48 is indicated with reference numeral 60. Each of widths 56 and 60 may be defined as the width of the respective digging face segment in a direction normal to the corresponding lengths, and extending between the corresponding proximal and distal edges. As shown in FIG. 4, each of digging faces 38, 40 and 42 may be planar and rectangular, and have lengths and widths equal to that of the corresponding body section. In a practical implementation strategy, length 50 may be from one-third to two-thirds of a sum of lengths 50, 54, and the corresponding length of section 46. The sum may be from two feet to fourteen feet although the present disclosure is not thereby limited. Width 56 may be less than width 60, and length 50 may be greater than width 56 by a factor of four or greater in certain embodiments. Widths 56 and 60 will typically be less than two feet.

As noted above, dozing blade 12 may include planar mounting surface 66 extending along lower edge 24 between wings 14 and 16, and oriented obliquely to a horizontal ground surface. Each of middle, first, and second body sections 44, 46 and 48 may include a planar back mounting face 68, 70 and 72, respectively, which contacts mounting surface 66 when cutter 30 is assembled in a service configuration upon blade 12 as shown in FIG. 1. In FIG. 4, package base 300 has an upper surface 301 defining a plane, and body sections 44, 46, and 48 are secured to package base 300 such that mounting faces 68, 70, and 72 contact upper surface 301 and are coplanar. In the packaged configuration shown in FIG. 4, digging face 38 is less steeply inclined to the plane defined by surface 301 than digging faces 40 and 42. This feature of cutter 30 is also evident when mounted in its service configuration, except in that case the relative inclinations may be understood in reference to the plane of mounting surface 66 and to horizontal ground surface. It may also be noted from FIG. 4 that each of body sections 44, 46 and 48 may define a generally polygonal cross-section, as may end plates 84 and 86. In the illustrated embodiment, body section 44 and end plates 84 and 86 may each be formed from a flat piece of rolled steel, whereas outer sections 46 and 48 may be cast or forged, for instance. In the FIG. 4 embodiment, end plates 84 and 86 have parallel front digging and back mounting faces. Also illustrated in FIG. 4 are bolting holes 62. It may be noted that bolting holes 62 may be arranged in a pattern defining a straight line extending generally parallel edges 32 and 34 of cutter 30, along each of body sections 44, 46 and 48. Bolting holes 62 may be located relatively closer to proximal edge 32 than to distal edge 34, although the present disclosure is not thereby limited. Bolting holes 62 formed in end plates 84 and 86 may be arranged in a similar pattern.

Figure 5:
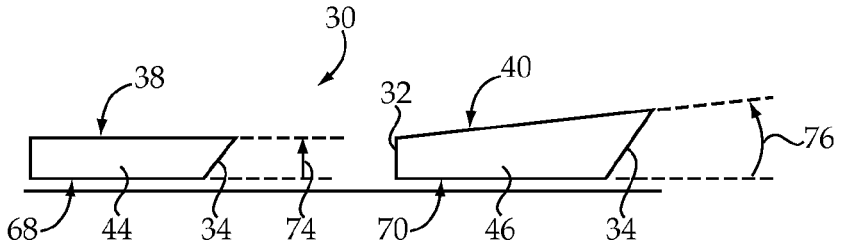
FIG. 5 is an end view of two sections of the cutter of FIG. 4.

Turning now also to FIG. 5, there is shown an end view of body section 44 and body section 46 as they might appear when back mounting faces 68 and 70 are positioned in a common plane, such as when resting upon base 300 or a horizontal ground surface. Although body section 48 is not shown in FIG. 6, since it may be substantially identical to body section 46, or a mirror image thereof, the present description should be understood to similarly apply. Body section 44 may define a first face angle 74 between center segment 38 of digging face 36 and back mounting face 68, the face angle lying in a plane normal to length 50. Body section 46 may define a second face angle 76 between outer segment 40 of digging face 36 and back mounting face 70, in an analogous plane. Second face angle 76 is a greater face angle and first face angle 74 is a lesser face angle in the FIG. 5 embodiment. A difference between second face angle 76 and first face angle 74 may be about 20° or less, and in one practical implementation strategy first face angle 74 may be about 0°, and second face angle 76 may be about 20° or less. In the FIG. 5 embodiment, the respective segments of digging face 36 and mounting face 70 upon section 44 are parallel. In other embodiments, parallel digging and mounting face segments are instead located on the outer body sections, and the middle body section may include non-parallel digging and mounting faces, as discussed below.

Figure 6:
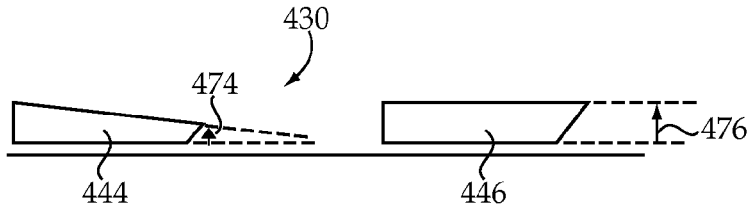
FIG. 6 is an end view of two sections of a cutter, according to another embodiment.
Figure 7:
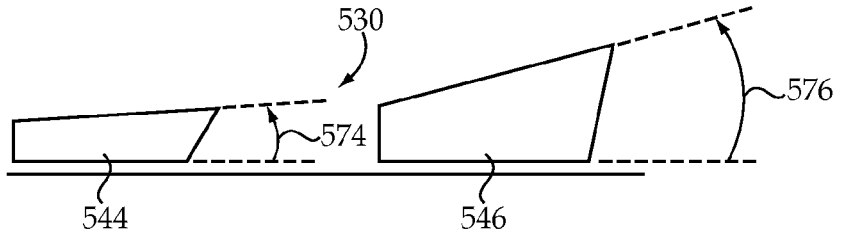
FIG. 7 is an end view of two sections of a cutter, according to yet another embodiment.

Referring also to FIG. 6, there is shown yet another embodiment of a cutter 430 according to the present disclosure. Cutter 430 includes a middle body section 444 and an outer body section 446, and will be understood to include another outer body section which is not shown in FIG. 6. In cutter 430, middle body section 444 defines a first face angle 474, whereas outer body section 446 defines a second face angle 476. It may be noted that in cutter 30, as shown in FIG. 5, middle body section 44 is flat and has parallel digging and mounting faces 38 and 68, such that angle 74 is about 0°. In the embodiment of FIG. 6, analogously defined first face angle 474 may be greater than 0°, and second face angle 476 may be about 0°. FIG. 7 illustrates yet another cutter 530, in which neither of a middle section 544 nor an outer section 546 defines a face angle of 0°. Instead, a first face angle 574 defined by middle section 544 may have a first size, and a second face angle 576 may have a second, greater size which is between the value of face angle 574 and face angle 574 plus about 20°.

Figure 8:
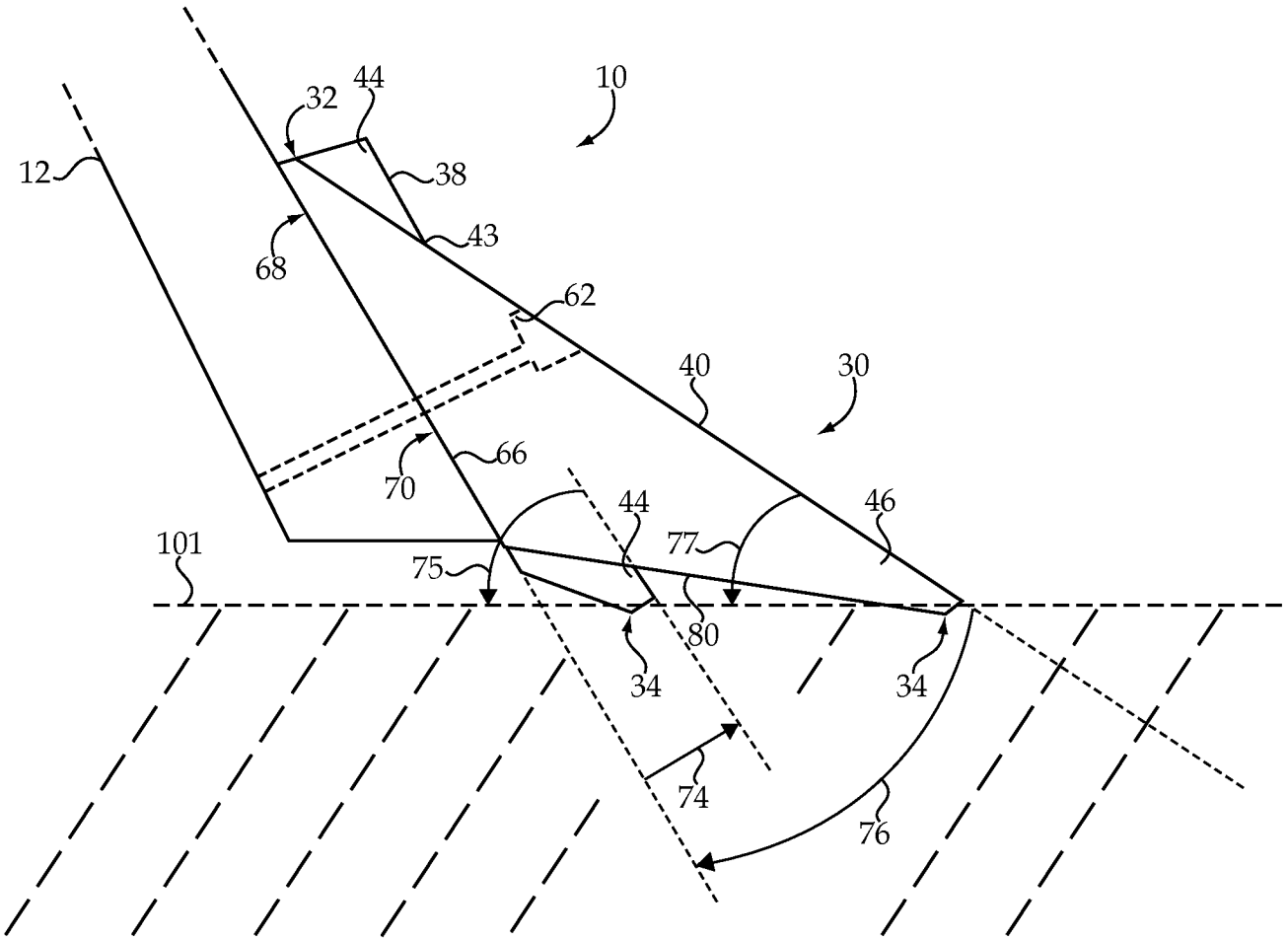
FIG. 8 is a side diagrammatic view of a cutter mounted upon a dozing blade, according to one embodiment.

Referring now to FIG. 8, there is shown cutter 30 mounted upon dozing blade 12 in its service configuration upon mounting surface 66. As noted above, mounting surface 66 may be planar. Mounting faces 68 and 70 of body sections 44 and 46 are oriented in the service configuration parallel to mounting surface 66, and in the illustrated case positioned in a first plane defined by mounting surface 66. The mounting face of body section 48 would also be positioned in the first plane, but is obscured from view in the FIG. 8 illustration. In the service configuration, distal cutting edge 34 of body section 46, and distal cutting edge 34 of body section 44 are oriented transverse to mounting surface 66 and positioned in a second plane transverse to the first plane, in the illustrated case the second plane being a horizontal plane defined by a substrate 101. As noted above body section 46 defines greater face angle 76 between its digging face 40 and mounting face 70 which is about 20° or less, and body section 44 defines lesser face angle 74 between its digging face 38 and mounting face 68. As a result, in the service configuration digging face 38 is less steeply inclined to mounting surface 66 and to the first plane, the plane defined by mounting surface 66, and more steeply inclined to the horizontal ground surface and the second plane, the plane defined by substrate 101, than digging face 68 of body section 46. Also shown in FIG. 8 is a base face 80 on body section 46 which adjoins distal cutting edge 34 and extends between digging face 40 and mounting face 70. Digging face 40, mounting face 70, and base face 80 in body section 46, and analogously in body section 48, defines a triangular cross-sectional shape.

As further discussed below, certain advantageous properties of the present disclosure relate to how steeply the different sections of a cutter for a dozing blade assembly are oriented relative to the ground. Since dozing blades themselves may have varying geometry, the values of the various face angles discussed herein can vary. While relatively small differences between face angles are contemplated herein, it should be noted that a difference between face angles of a middle body section and outer body sections which results from variations within manufacturing tolerances would not satisfy the intended understanding of "steep" versus "shallow." Typically, either middle body section 44, or both of outer body sections 46, will be flat such that the corresponding face angle is about 0° for purposes of manufacturing economy, although as illustrated in FIG. 7 alternatives are contemplated. Except where a dozing blade mounting surface is purpose-built to obtain different effective face angles with flat cutter plates in service, or some other modification, such as wedge-shaped shims, is used, body sections 44, 46, 48 will not all be flat and define face angles of 0°.

INDUSTRIAL APPLICABILITY

Figure 9:
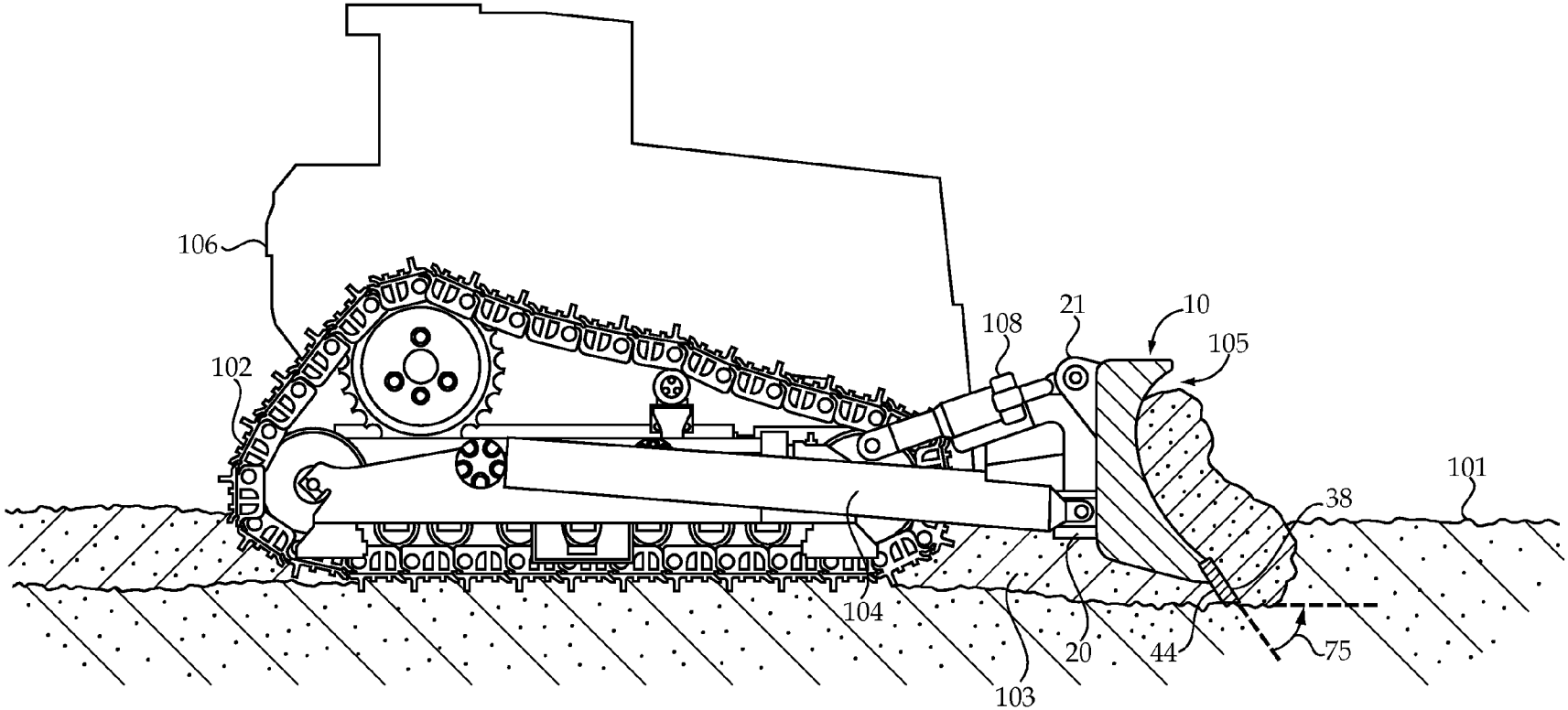
FIG. 9 is a side diagrammatic view of a tractor at one stage of a dozing process, according to one embodiment.
Figure 10:
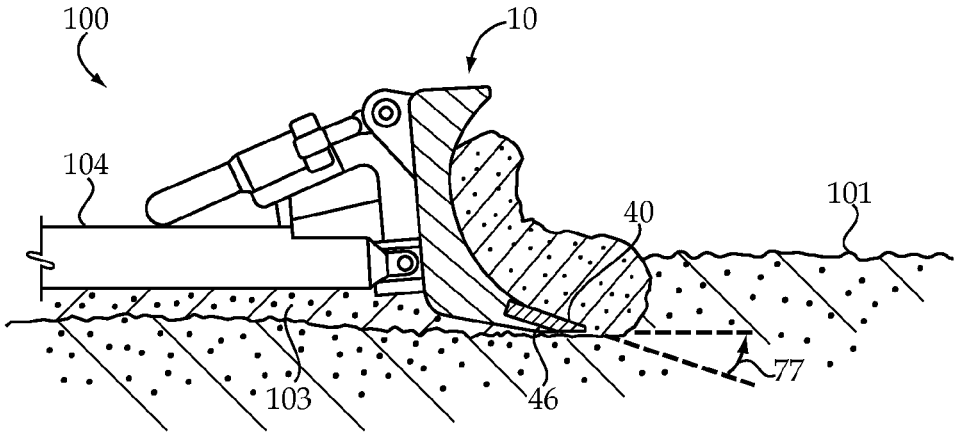
FIG. 10 is a side diagrammatic view of a portion of the tractor of FIG. 9, at another stage of the dozing process.

Referring also now to FIGS. 9 and 10, there is shown a track-type tractor 100 having a track 102 coupled with a frame 106, and an implement system 105. A dozing blade assembly 10 similar to assembly 10 of FIGS. 1 and 2 is coupled with a set of push-arms 104 of tractor 100 and a tilt actuator 108. No lift or pivot actuators are shown, although tractor 100 might be thusly equipped. In FIG. 9, dozing blade assembly 10 is shown in a sectioned view as it might appear where the section plane passes vertically through assembly 10 approximately at a horizontal centerpoint, such that middle body section 44 of cutter 30 is visible within a slot 103 being formed in a substrate 101. In FIG. 10, assembly 10 is shown sectioned as it might appear where the section plane passes vertically through assembly 10 such that outer body section 46 is visible. Digging face segment 38 of middle body section 44 is oriented at a steep cutting angle 75 relative to a horizontal plane, for example from about 40° to about 55°. Digging face segment 40 of outer body section 46 is more shallowly oriented relative to the horizontal plane at an angle 77 which is from about 25° to about 45°.

It will be recalled that face angles 74 and 76 may differ from one another by about 20° or less. While the disclosed ranges for angles 77 and 75 overlap, and at their extremes could result in a difference between the face angles of greater than 20°, those skilled in the art will appreciate in view of the other teachings herein that face angles 74 and 76 may nevertheless be selected such that the difference between the face angles is about 20° or less. The term "about" is used herein in the context of conventional rounding to a consistent number of significant digits. Accordingly, "about 20°" means from 15° to 24°, "about "0°" means 0° plus 0.4° or minus 0.5°, and so on.

It will be recalled that the different orientations of digging face segment 38 versus digging face segments 40 and 42 may balance downward penetrability with forward pushability of cutter 30, and thus dozing blade assembly 10, through material of a substrate. Body section 44 may be urged vertically through material of substrate 101 relatively easily, but with relatively more difficulty urged horizontally through the material. In comparison, section 46 may be relatively more difficult to urge in a vertical direction, but relatively easier to urge in a horizontal direction. As tractor 100 is moved in a generally forward direction, left to right in FIGS. 9 and 10, slot 103 may be formed in substrate 101, by inducing failure of substrate 101, and such that material loosened via the induced failure flows in a generally upward direction across the material molding surface of the dozing blade, and is ultimately pushed in a forward direction via the movement of tractor 100. This will generally occur, based on the differently oriented digging face segments of cutter 30, and without any adjustment to a tilt angle of assembly 10, such that the likelihood of stalling or skimming the dozing blade and/or tractor is reduced. In forming slot 103, failure of substrate 101 may be induced via shattering, in contrast to other digging techniques such as scraping, in which a ribbon of material is sliced off. As noted above, cutting angle 75 may be from about 40° to about 55°, and cutting angle 77 may be from about 25° to about 45°. In a further practical implementation strategy, angle 75 may be equal to about 50°, and angle 77 may be equal to about 30°, and more particularly still angle 75 may be equal to about 52° and angle 77 equal to about 31°. In this latter specific embodiment, the face angle of middle section 44 may be about 0° while the face angle of outer section 46 may be about 20°. In other example embodiments, angle 75 may be equal to about 52°, angle 77 equal to about 38°, the face angle of middle section 44 equal to about 0° and the face angle of outer section 46 equal to about 16°. In still another example, angle 75 is about 52°, angle 77 is about 45°, the face angle of middle section 44 is about 0° and the face angle of outer section 66 is about 7°.

Figure 11:
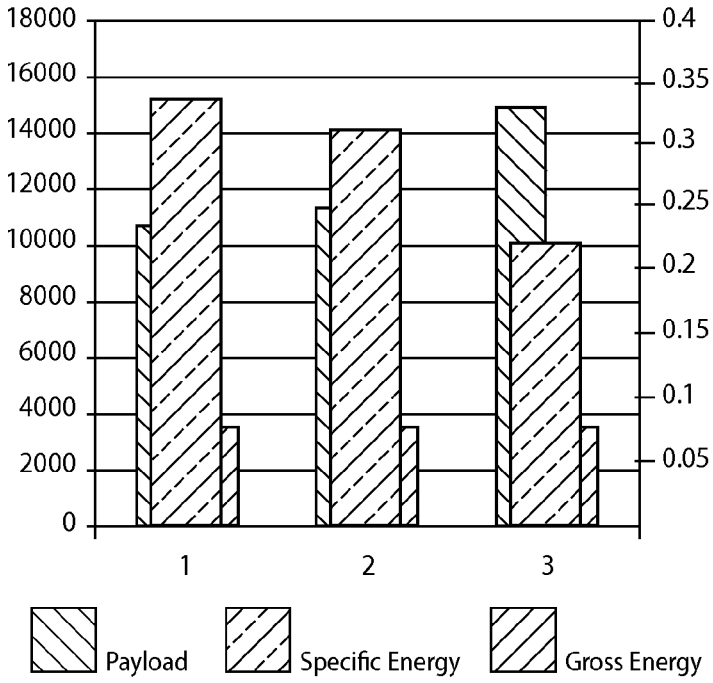
FIG. 11 is a bar chart illustrating certain dozing parameters for a dozing blade assembly according to the present disclosure, in comparison with other designs.

Referring now to FIG. 11, there is shown data via a bar chart reflecting payload, specific energy, and gross energy for a first dozing blade assembly 1, a second dozing blade assembly 2, and a third dozing blade assembly 3. The data in FIG. 11 are full scale data derived from scale model laboratory testing. Dozing blade assemblies 1 and 2 represent dozing blades having a cutter with a design different from the designs of the present disclosure, and in particular having a middle body section and outer body sections which are not differently oriented, in other words extending straight across the front of the dozing blade assembly and having digging faces in a common plane. Assembly 3 represents data which might be expected to be obtained with a dozing blade having the differently oriented digging face segments, i.e. steep middle and shallow outer, of the present disclosure. Each of assemblies 1, 2 and 3 was passed through material having scaled down soil properties until the maximum payload capacity was obtained. The units shown on the left side of FIG. 11 represent payload in kilograms of material. It may be noted that a payload with dozing blade assembly 1 is slightly greater than 10,000 kilograms, whereas a payload with dozing blade assembly 2 is slightly more than 11,000 kilograms. A payload using dozing blade assembly 3 is approximately 15,000 kilograms, representing an increase in payload of at least 25% over the other designs. Gross energy is generally less with dozing blade assembly 3 than with either of dozing blade assemblies 1 and 2. With regard to specific energy, which includes a quantity of energy consumed per unit of material moved such as kilojoules per kilogram, and is perhaps the most useful metric of production dozing efficiency, it may be noted that dozing blade assembly 3 has a specific energy of about 0.225 as shown on the right side of FIG. 11, whereas dozing blade assemblies 1 and 2 each have a specific energy greater than 0.3 units of energy per unit mass of material, representing an efficiency advantage with the present design of at least 25%, and which is expected in certain instances to be at least 30%.

Figure 12:
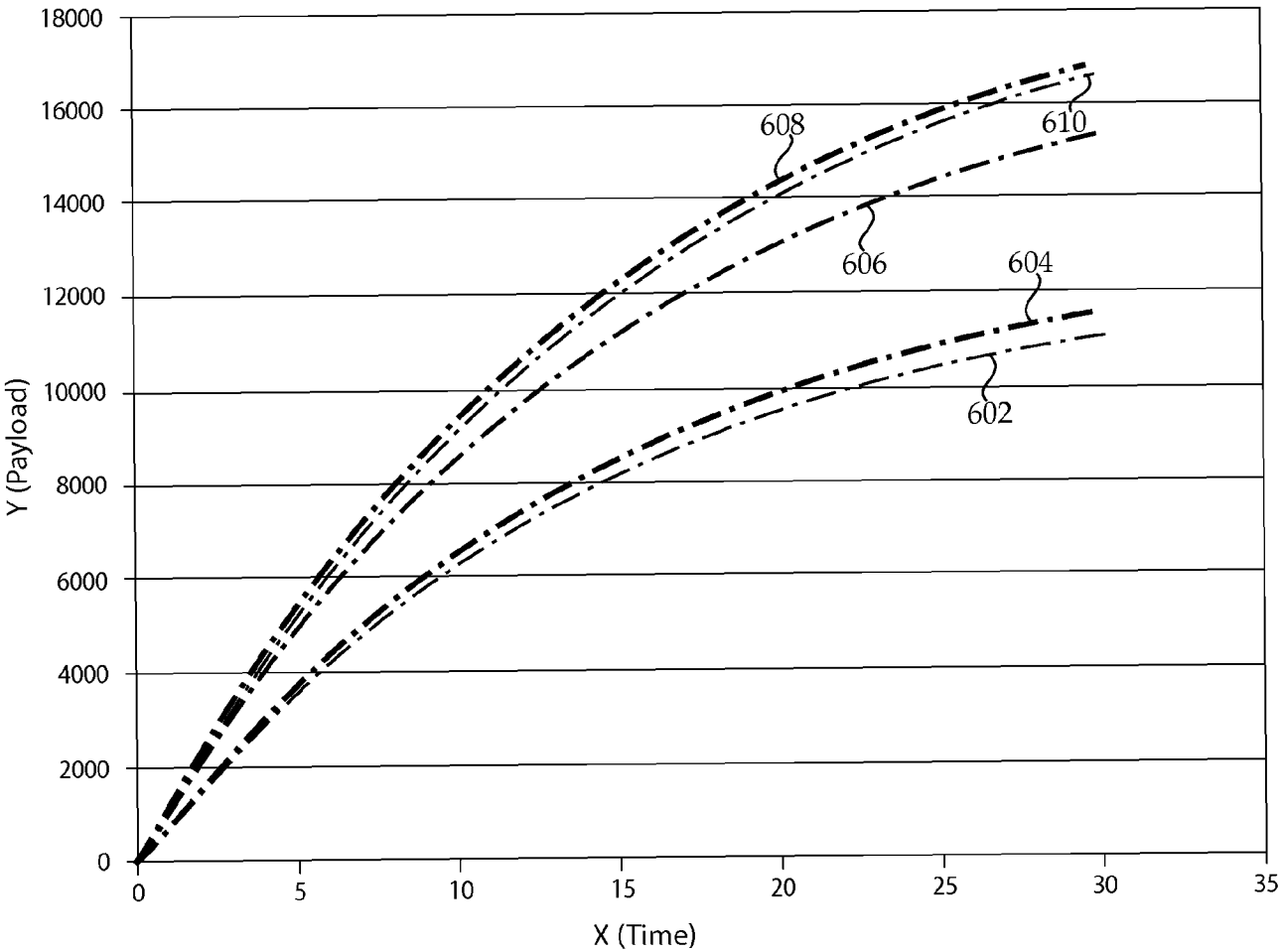
FIG. 12 is a graph of load growth curves for cutting edges according to the present disclosure, in comparison with load growth curves for a known cutter design in both laboratory and field conditions.

Referring now to FIG. 12, there is shown a graph relating payload on the Y-axis to time on the X-axis for a plurality of different cutter configurations. Curve 602 represents baseline laboratory test data for a cutter having a digging face at a uniform inclination relative to an underlying substrate, the inclination of the digging face being about 50°. Curve 604 represents field data for a similarly configured cutter. It may be noted that the baseline data and field data demonstrate similar load growth over time. Curve 606 represents laboratory test data illustrating load growth for a cutter in which a middle section has a digging face oriented at about 44° relative to an underlying substrate and outer sections with digging faces oriented at about 30°. Curve 608 represents laboratory test data illustrating load growth for a cutter in which a middle section has a digging face oriented at about 50° and outer sections oriented at about 38°, relative to an underlying substrate, whereas curve 610 represents laboratory test data illustrating load growth for a cutter with a middle section having a digging face oriented at about 39° and outer sections with digging faces oriented at about 24°, relative to the underlying substrate.

It may be noted from FIG. 12 that the cutters used in generating the data for curves 606, 608, and 610 impart an initially steeper, and thus generally superior, load growth curve. This difference is believed to be due to the use of the differently oriented digging faces on the different sections of the cutters contemplated herein, which enable the dozing blade assembly to cut more material in a given time increment than known configurations. The data represented in FIG. 12 were gathered using a consistent soil type and consistent test conditions, apart of course from the field data which nevertheless matches fairly closely to the counterpart baseline data. In selecting a cutter configuration that will be optimized for a broad range of substrate material types, a cutter having a center section with a digging face at an inclination similar to that of the cutter used in generating the data for curve 606, but outer sections having digging faces oriented close to those of the cutter used in generating the data shown via curve 608 may be used. In other words, an optimized version may include a center section having a digging face oriented at about 30° to the horizontal and outer sections oriented at about 50° to the horizontal. Such a configuration is believed to be capable of penetrating relatively harder substrate materials, but overall less sensitive to substrate material type despite potentially more modest performance than what could theoretically be obtained in certain instances.

As discussed above, in earlier strategies production was often limited by either too great a tendency of the cutter of the dozing blade assembly to penetrate downward into material of a substrate, ultimately stalling the dozing blade assembly and tractor, or downward penetration was relatively more difficult and forward pushability was relatively easier, sometimes resulting in skimming the dozing blade assembly or cutting at too shallow a depth. In either case, it was typically necessary to perform a greater number of material removal passes, back up and repeat a pass when the tractor stalled, or simply accept the relatively low efficiency of the overall production dozing process. While operators may be able to manipulate the blade during dozing to lessen the likelihood of these problems, not all operators are sufficiently skilled to do this, nor are all dozing blades and tractors equipped to enable such techniques.

The present disclosure thus reflects the insight that the relative ease with which a cutter can be urged through material vertically versus horizontally can be balanced such that penetrability and pushability are optimized, to in turn optimize production. This is achieved without the need for adjustable and relatively complex systems such as Cobb, discussed above. While certain other known strategies claim to achieve increased production dozing efficiency by way of specialized blade and/or moldboard configurations, the present disclosure achieves increased efficiency by way of features of the cutter, and is thus applicable to many different types of blades.

From the foregoing description, it will further be appreciated that many combinations of cutter body section geometry can yield a cutter for a dozing blade assembly having the desired characteristics. The specific geometry chosen, such as the size of the face angles of the respective body sections may be tailored to suit the geometry of the mounting face on the dozing blade to which the cutter is to be mounted. Various parameters of a cutter may also be tailored based upon the intended service applications. For very tough substrates, such as rock, the middle section of the cutter may be designed such that the center section of the digging face is both relatively steep with respect to an underlying substrate and relatively long. For very soft substrates, such as certain sandy soils, the middle section may be designed such that the center segment of the digging face is both relatively shallow and relatively short. For substrates of intermediate toughness, the inclination of the center segment may be medium, as may its length.

It should further be appreciated that body section length and digging face inclination are factors which can be independently varied. Thus, for a given steepness of the center digging face segment, a relatively longer length of the middle body section can yield greater penetrability and lesser pushability, whereas a relatively shorter length can yield lesser penetrability and greater pushability. As noted above, a length of the middle body section which is from one-third to two-thirds of the sum of the lengths of the middle and outer body sections, may be sufficient to cause the interaction of the cutter with material of a substrate to be determined by both the middle body section and the outer body sections. In general terms, the middle body section should not be made so short relative to the other body sections that it has only a minimal effect on the dozing behavior of the cutter, nor so long that the middle body section overwhelmingly determines the behavior of the cutter. With regard to varying steepness of the digging face on the middle body section, if made steeper than the generally ranges disclosed herein, the reduced pushability may be problematic, whereas if made too shallow, the cutter may fail to penetrate. As to the difference in inclination between the respective digging face segments in the service configuration, if made too large the cutter may have too much overall resistance to moving through a substrate, and thus neither optimum pushability nor optimum penetrability.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A cutter for a dozing blade in an implement system of a tractor comprising:

an elongate multi-piece body having a one-piece middle body section, a one-piece first outer body section, and a one-piece second outer body section, each including a proximal edge and a distal cutting edge;

the middle, first, and second body sections each further including a front digging face, a back mounting face, and defining a plurality of bolting holes communicating between the digging and mounting faces;

the middle, first, and second body sections each further including a length extending between a first and a second outboard edge, a width less than their length, and their proximal and distal cutting edges being oriented so as to define parallel line segments extending from their first outboard edge to their second outboard edge;

the cutter further including a first and a second end plate positionable outboard of the first and second body sections, and the first and second end plates each having lengths which are less than the lengths of the middle, first, and second body sections;

the bolting holes in each body section being spaced from the corresponding proximal, distal cutting, and outboard edges, and configured to receive bolts for mounting the elongate multi-piece body in a service configuration upon a mounting surface of the dozing blade, in which the mounting faces are positioned in a first plane and the distal cutting edges are positioned in a second plane transverse to the first plane; and the first and second body sections each defining a greater face angle between their digging and mounting faces which is about 20° or less, and the middle body section defining a lesser face angle between its digging and mounting faces, such that in the service configuration the digging face of the middle body section is less steeply inclined to the first plane and more steeply inclined to the second plane than the digging faces of the first and second body sections.

2. The cutter of claim 1 wherein the proximal edges together have a continuous linear profile in the first plane, and the distal edges together have a discontinuous indented profile in the second plane, in the service configuration.

3. The cutter of claim 1 wherein each of the digging faces is planar and rectangular and has a length and width equal to that of the corresponding body section.

4. The cutter of claim 3 wherein the lengths and widths of the first and second body sections are equal, and wherein the length of the middle body section is from one-third to two-thirds of a sum of the lengths of the middle, first, and second body sections and the width of the middle body section is less than the widths of the first and second body sections.

5. The cutter of claim 4 wherein the sum of the lengths of the middle, first, and second body sections is from two feet to fourteen feet, and the widths of each of the middle, first, and second body sections are each less than two feet.

6. The cutter of claim 2 wherein the digging and mounting faces of the middle body section are parallel such that the lesser face angle is about 0°.

7. The cutter of claim 6 wherein the first and second body sections each further include a base face extending between the digging and mounting faces and adjoining the distal cutting edge, and the digging, mounting, and base faces in each of the first and second body sections define a triangular cross-sectional shape.

8. A dozing blade service package comprising:

a replacement cutter for installation in place of a used cutter in a dozing blade of an implement system in a tractor, the replacement cutter including an elongate multi-piece body having a one-piece middle body section, a one-piece first outer body section, and a one-piece second outer body section, each including a proximal edge, and a distal cutting edge, and a first and a second outboard edge;

the middle, first, and second body sections each further including a front digging face extending between the proximal and distal edges, a back mounting face, and defining a plurality of bolting holes communicating between the digging and mounting faces;

the middle, first, and second body sections each further including a length extending between a first and a second outboard edge, a width less than their length, and their proximal and distal cutting edges being oriented so as to define parallel line segments extending from their first outboard edge to their second outboard edge;

the cutter further including a first and a second end plate positionable outboard of the first and second body sections, and the first and second end plates each having lengths which are less than the lengths of the middle, first, and second body sections;

the plurality of bolting holes in each body section being spaced from the corresponding proximal, distal cutting, and outboard edges, and configured to receive bolts for mounting the elongate multi-piece body for service upon a mounting surface of the dozing blade oriented obliquely to a horizontal ground surface, such that the mounting faces are oriented parallel to the mounting surface and the distal cutting edges are oriented transverse to the mounting surface;

the first and second body sections each further defining a greater face angle between their digging and mounting faces which is about 20° or less, and the middle body section defining a lesser face angle between its digging and mounting faces, such that when mounted for service the digging face of the middle body section is less steeply inclined to the mounting surface and more steeply inclined to the horizontal ground surface than the digging faces of the first and second body sections;

the middle, first, and second body sections each having a length extending between a first and a second outboard edge, and a width extending between the proximal and distal edges which is less than the length; and a packaging system securing the middle, first, and second body sections in a fixed configuration for shipping.

9. The service package of claim 8 wherein the first and second body sections each further include a base face extending between their digging and mounting faces and adjoining the distal cutting edge, and wherein the digging, mounting, and base faces in each of the first and second body sections define a triangular cross-sectional shape.

10. The service package of claim 9 wherein the digging and mounting faces of the middle body section are parallel such that the lesser face angle is about 0°.

11. The service package of claim 10 wherein the lengths of the first and second body sections being equal, and the length of the middle body section being from one-third to two-thirds of a sum of the lengths of the middle, first, and second body sections and the width of the middle body section being less than the widths of the first and second body sections.

12. The service package of claim 11 wherein the sum of the lengths of the middle, first, and second body sections is from two feet to fourteen feet.

13. The service package of claim 8 wherein each of the digging faces is planar and rectangular, and wherein the packaging system includes a package base having an upper surface defining a plane and the middle, first, and second body sections are secured to the package base such that their mounting faces contact the upper surface.

14. The service package of claim 13 wherein the digging face of the middle body section is less steeply inclined to the plane than the digging faces of the first and second body sections.

* * * * *